United States Patent [19]

Jensen

[11] Patent Number: 4,766,877

[45] Date of Patent: Aug. 30, 1988

[54] CATALYTIC SPACE HEATER

[75] Inventor: William F. Jensen, Olympia, Wash.

[73] Assignee: Thermal Systems, Inc., Tumwater, Wash.

[21] Appl. No.: 103,931

[22] Filed: Sep. 30, 1987

[51] Int. Cl.[4] ..... F24C 3/04

[52] U.S. Cl. ..... 126/92 AC; 431/20; 431/328

[58] Field of Search ..... 431/20, 328; 126/92 R, 126/92 C, 92 AC

[56] References Cited

U.S. PATENT DOCUMENTS

| | | |
|---|---|---|
| 1,224,497 | 5/1917 | O'Dowd . |
| 1,287,405 | 12/1918 | O'Dowd . |
| 1,685,759 | 9/1928 | Walter . |
| 2,087,983 | 7/1937 | Martin . |
| 2,262,948 | 12/1940 | Long . |
| 2,263,170 | 11/1941 | Haedike . |
| 2,658,742 | 11/1953 | Suter et al. . |
| 2,748,842 | 6/1956 | Ivie et al. . |
| 2,806,465 | 9/1957 | Hess . |
| 2,870,828 | 1/1959 | Hess . |
| 2,870,829 | 1/1959 | Williams . |
| 3,029,802 | 4/1962 | Webster . |
| 3,147,960 | 9/1964 | Ruff . |
| 3,187,741 | 6/1965 | Oatley . |
| 3,191,659 | 6/1965 | Weiss . |
| 3,198,240 | 8/1965 | Keith et al. . |
| 3,199,568 | 8/1965 | Baumanns et al. . |
| 3,260,255 | 7/1966 | Oatley . |
| 3,270,798 | 9/1966 | Ruff . |
| 3,343,586 | 9/1967 | Berchtold et al. . |
| 3,366,333 | 1/1968 | Diehl . |
| 3,395,693 | 8/1968 | Cowan . |
| 3,425,675 | 2/1969 | Twine . |
| 3,498,732 | 3/1970 | Schantz . |
| 3,590,806 | 7/1971 | Locke . |
| 3,591,322 | 7/1971 | Derringer et al. . |
| 3,650,262 | 3/1972 | Root et al. . |
| 3,662,737 | 5/1972 | Richards . |
| 3,698,378 | 10/1972 | Rosenberg et al. . |
| 3,963,414 | 6/1976 | Jensen . |

FOREIGN PATENT DOCUMENTS

| | | |
|---|---|---|
| 27244/67 | 9/1967 | Australia . |
| 30514/67 | 11/1967 | Australia . |
| 35725/68 | 3/1968 | Australia . |
| 39200/68 | 6/1968 | Australia . |
| 16811/70 | 6/1970 | Australia . |
| 25775/71 | 2/1971 | Australia . |
| 251567 | 2/1911 | Fed. Rep. of Germany . |
| 1551982 | 4/1971 | Fed. Rep. of Germany . |
| 1128421 | 2/1955 | France . |
| 1136330 | 8/1955 | France . |
| 1302578 | 7/1961 | France . |
| 1433722 | 4/1965 | France . |
| 2024094 | 8/1970 | France . |
| 2286356 | 4/1976 | France . |
| 250500 | 4/1926 | United Kingdom . |
| 580215 | 8/1946 | United Kingdom . |
| 815308 | 6/1959 | United Kingdom . |
| 862306 | 3/1961 | United Kingdom . |
| 1006938 | 10/1965 | United Kingdom . |
| 1210478 | 10/1970 | United Kingdom . |
| 2020794 | 11/1979 | United Kingdom . |

*Primary Examiner*—Carroll B. Dority, Jr.

*Attorney, Agent, or Firm*—Seed and Berry

[57] ABSTRACT

A catalytic bed has an upright forward surface openly exposed to the living space and generates a partially laminar flow and a partially turbulent flow of substantially smokeless gaseous combustion products upward along the bed surface, with laminar flow adjacent thereto and the turbulent flow positioned forward thereof. A collection chamber is positioned above the bed and has spaced apart lower and upper walls to define a rearward collection chamber and a forward inlet space. A negative pressure source is connected to the collection space to create an exhaust flow therefrom. A baffle wall extends laterally and projects upwardly from the lower wall toward the upper wall, terminating at a distance therefrom to create a pressure drop between the collection and inlet spaces sufficient to provide a substantially uniform draw along the length of the baffle wall. The upper wall projects forward beyond the bed surface and downward to define an opening to the inlet space, with the forward projection being beyond the turbulent flow so that the inlet opening captures therein both the laminar and turbulent flows when rising under their natural buoyancy and draws in from the living space under the influence of the pressure source a curtain flow of air from the living space forward of the turbulent flow to block escape of the turbulent flow.

10 Claims, 3 Drawing Sheets

FIG. 3
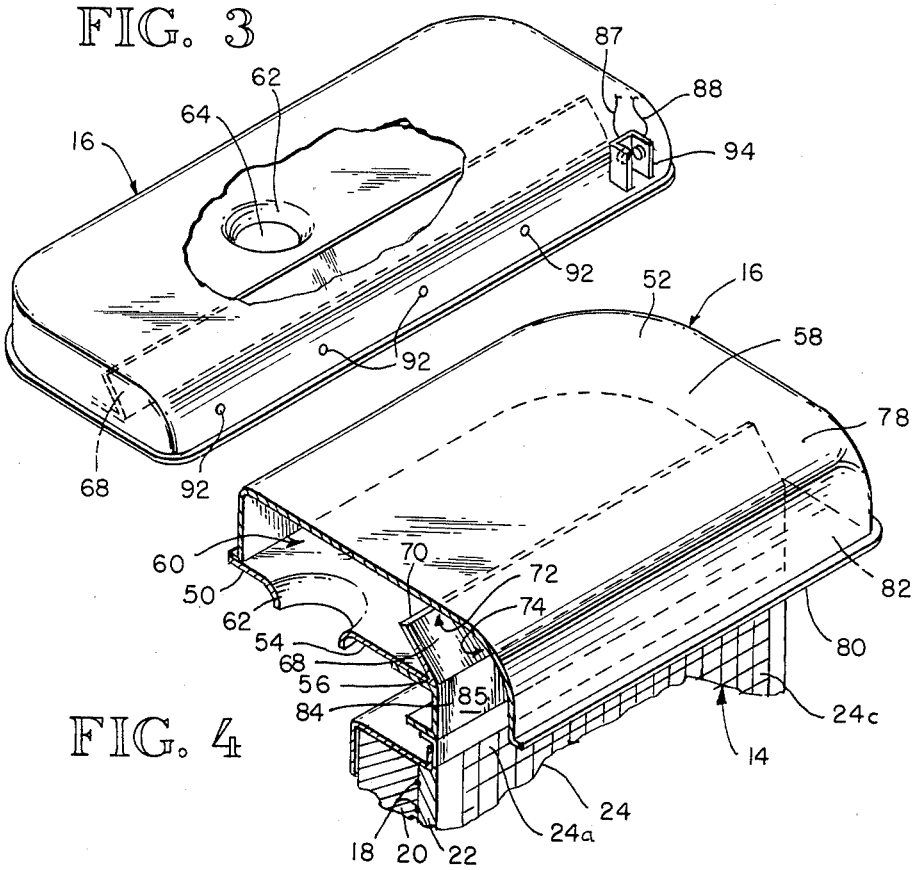
FIG. 4
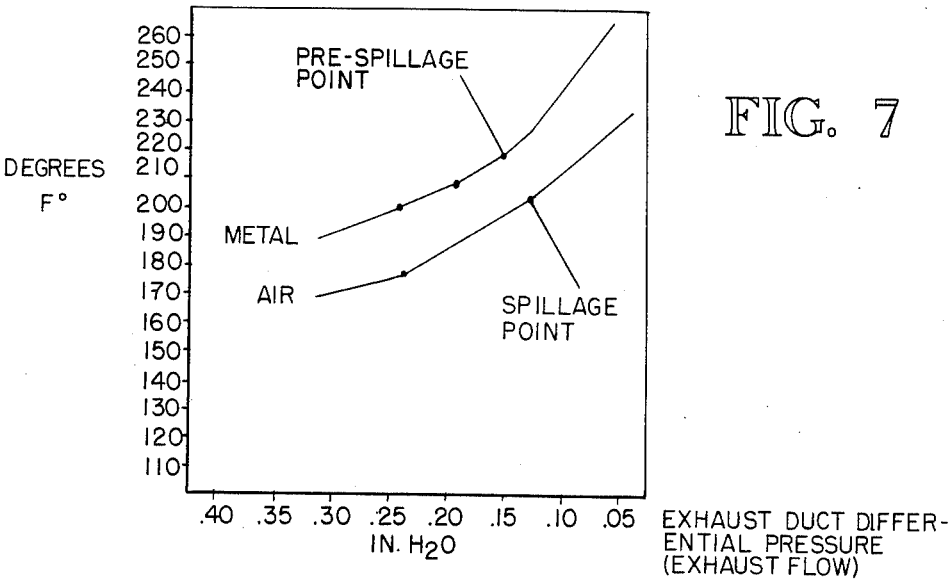
FIG. 7

CATALYTIC SPACE HEATER

TECHNICAL FIELD

The present invention relates generally to catalytic space heaters, and more particularly, to a catalytic space heater usable in an enclosed living space.

BACKGROUND OF THE ART

Catalytic bed space heaters are well known and use as a fuel either combustible gas, such as butane, natural gas (methane) or propane, or a gas-forming liquid hydrocarbon, such as gasoline or some other liquid which forms a combustible gas such as methyl alcohol. Such a catalytic space heater is compact, convenient and attractive for use in an enclosed living space.

Three principal difficulties have been experienced with such heaters, however. When used as unvented heaters they will not comply with most building, installation and use codes presently in existence. Furthermore, even when vented catalytic space heaters of prior designs such as the design shown in U.S. Pat. No. 3,963,414, could not pass certification tests that require proof that all combustion gases have been collected for removal from the living space without excessive heat loss. Finally, when attempts were made to utilize a higher speed exhaust blower motor to meet the certification test, the heating and fuel efficiency of the prior design catalytic space heater was significantly reduced by excessive withdrawal of heated air from the living space and by premature withdrawal of combustion gases from the burner surface. In addition, the use of a high speed blower motor resulted in unacceptably high noise levels. Moreover, with the prior design mentioned should for some reason the exhaust duct flow be even slightly restricted, the combustion gases spill from the heater collection into the living space. This can result from adverse wind conditions at the exhaust outlet or a partially blocked flue, both of which inhibit or reduce the rate of exhaust flow.

It will therefore be appreciated that there has been a significant need for a catalytic space heater for heating an enclosed living space which can collect and remove from the living space substantially all combustion gases of the heater, and do so without significantly reducing the efficiency of the heater. Furthermore, the heater should operate at a relatively low exhaust flow rate with an exhaust blower motor operating at a low enough speed that it does not produce excessive noise. In addition, it is important that the spillage point of the heater occur at a sufficiently low exhaust flow that operation of the heater is not adversely affected by normal wind conditions at the exhaust outlet or by a partially blocked flue which might inhibit or reduce the rate of exhaust flow. Similarly, the heater should be operable with a low exhaust flow so that under normal operation the exhaust flow is sufficient to prevent spillage, but yet need not be very high to avoid the conventional flow-sensing safety controls, which terminate the fuel flow to the bed if insufficient exhaust flow is sensed, causing frequent nuisance lockouts of the fuel flow. The present invention fulfills these needs and provides other related advantages.

DISCLOSURE OF THE INVENTION

The present invention resides in a catalytic space heater for heating an enclosed living space. The heater includes a catalytic bed having an upwardly extending forward surface positionable to be openly exposed to the living space. The bed is defined by upper and lower borders and left and right side borders. The exposed bed surface generates during operation of the heater under a flow of fuel, a partially laminar flow and a partially turbulent flow of substantially smokeless gaseous combustion products upward along the bed surface. Each of the flows extends between the left and right bed side borders, with the laminar flow being adjacent to the bed surface and the turbulent flow being positioned forward of the laminar flow.

A pressure source is provided sufficient to create a negative pressure exhaust flow. A sensor control senses exhaust flow and terminates the flow of fuel to the catalytic bed if the sensed exhaust flow is below a predetermined level selected at or above an exhaust flow necessary to prevent gas spillage.

The invention further includes a collection chamber positioned above the bed and having a lower wall and an upper wall. Each of the walls extend laterally substantially between the left and right bed side borders. The lower wall has a rearward wall portion generally rearward of the bed surface and terminating at a forward edge portion.

The upper wall has a rearward wall portion generally rearward of the bed surface and spaced above the lower rearward wall portion to define an interior collection space therebetween. The pressure source is connected to this collection space to create the exhaust flow therefrom.

The lower wall further has a baffle wall portion extending laterally substantially between the left and right bed side borders and projecting upwardly from the lower forward wall portion and terminating at a baffle wall upper edge portion spaced below the upper rearward wall portion. The baffle wall creates a pressure drop between the collection space and an inlet space forward of the baffle wall portion sufficient to provide a substantially uniform draw along the length of the baffle wall portion.

The upper wall portion further has a forward wall portion projecting forwardly beyond the bed surface and downward and terminating at an upper wall forward edge portion. The upper forward wall portion and the baffle wall portion define the inlet space therebetween. The upper wall forward edge portion is positioned generally above the bed surface and spaced forwardly thereof sufficient to be positioned forward beyond the turbulent flow and define an opening to the inlet space communicating with the living space. The opening extends laterally substantially between the left and right bed side borders. The opening is sufficiently large in the forward direction to capture therein both laminar flow and the turbulent flow when rising under their natural buoyancy and to draw in under the influence of the pressure source a curtain flow of air from the living space positioned forward of the turbulent flow and extending laterally substantially between the left and right bed side borders. This curtain flow of air blocks escape or spillage of the upward turbulent flow forward of the upward wall forward portion into the living space.

The pressure source creates a sufficient exhaust flow to produce the curtain flow of air to block escape of the turbulent flow and also to produce the exhaust flow above the predetermined level under normal operation to prevent the sensor control from terminating the flow of fuel. The exhaust flow is not, however, so great as to significantly reduce the fuel efficiency of the heater by withdrawing the gaseous combustion products prior to being substantially fully combusted.

The preferred embodiment in the invention, the baffle wall projects rearwardly from the lower forward wall portion at a rearwardly slanted angle to form the inlet space as an upwardly expanding interior space in which the laminar flow and the turbulent flow can expand immediately and progressively upon entering the inlet space. This avoids the flows displacing the curtain flow of air upon entering the inlet space. The baffle is preferably slanted at an angle between 30 to 60 degrees relative to the bed forward surface.

In an alternative embodiment of the invention, the catalytic bed is positioned with the upper border of the bed surface below the collection chamber lower wall by a sufficient distance to ensure substantially complete combustion of the laminar flow and the turbulent flow before entering into the inlet space opening.

Other features and advantages of the invention will become apparent from the following detailed description, taken in conjunction with the accompanying drawings.

BRIEF DESCRIPTION OF THE DRAWINGS

FIG. 3 is an enlarged perspective view of the chamber used in the heater of FIG. 1 shown disassembled from the heater, with a pair of thermocouples mounted thereon for test purposes.

FIG. 4 is an enlarged fragmentary, sectional perspective view of an alternative embodiment of the heater of the present invention utilizing a chamber positioned at a distance above the upper border of the catalytic bed surface to improve efficiency.

FIG. 7 is a graph showing spillage point test data for the heater of the present invention shown in FIG. 1.

BEST MODE FOR CARRYING OUT THE INVENTION

Figure 2:
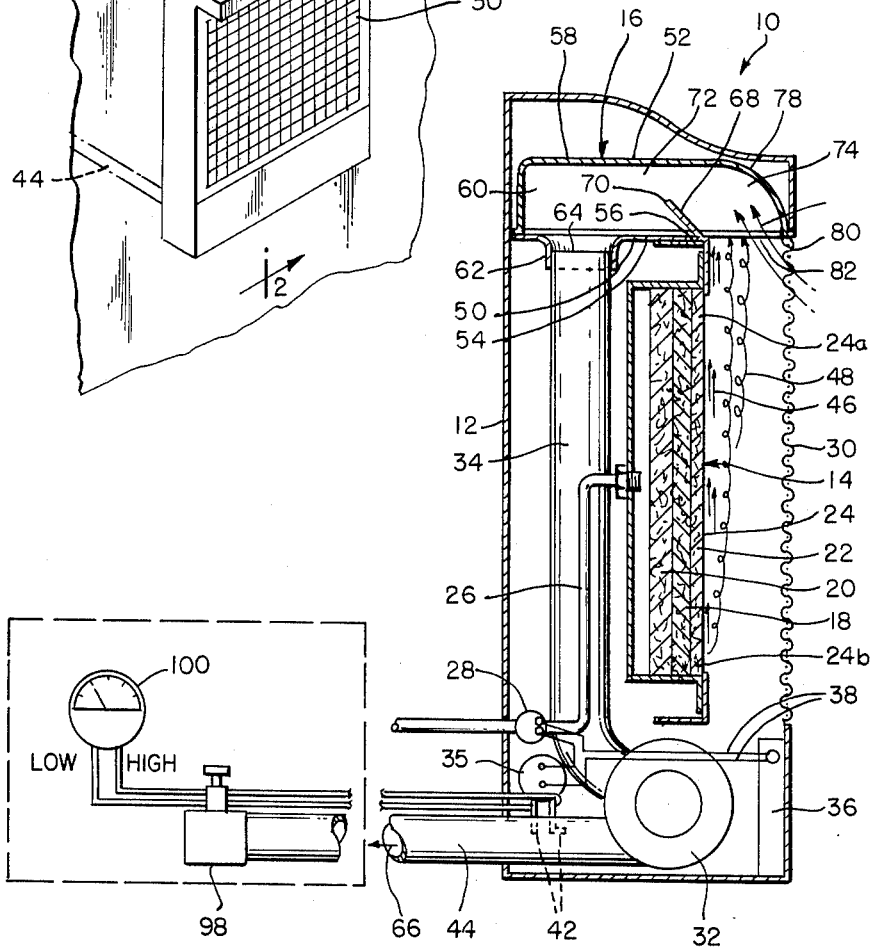
FIG. 2 is an enlarged sectional view taken substantially along the line 2—2 of FIG. 1, also shown in a broken line block is an associated test fixture.
Figure 5:
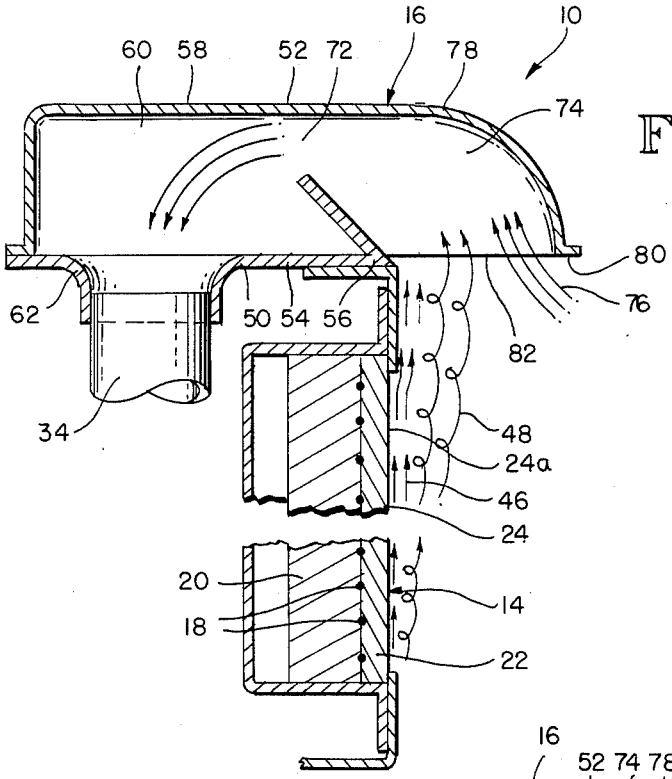
FIG. 5 is an enlarged fragmentary, sectional side elevational view of the chamber and catalytic bed of the heater shown in FIG. 1.

As shown in the drawings for purposes of illustration, the present invention is embodied in a catalytic space heater, indicated generally by reference numeral 10. As best shown in FIG. 2, the space heater 10 includes an exterior casing 12 enclosing a conventional open burner catalytic bed 14 and a collection chamber 16 positioned thereabove. The catalytic bed 14 includes a layer of ignition wires 18, a gas diffuser layer 20 positioned forward thereof, and a catalytic burner element 22 forwardmost positioned and having an upright forward surface 24 positioned to be openly exposed to a living space in which the heater 10 is to serve as a source of heat. The heater 10 may be gas fired and the burner element 22 may be a bed of high temperature refractory material or other heat resistant inert mineral to which a very thin coating of platinum group metal has been applied to serve as a catalyst. A combustible gas is supplied to the rearward side of the catalytic bed 14 through a gas supply tube 26 with flow in the gas supply tube being turned off and on by a solenoid gas supply valve 28.

The catalyst enables gas supplied to the catalytic bed 14 to burn at the radiating forward surface 24 of the bed at a lower temperature than would otherwise be required for flame combustion of the gas. The heat of the burning gas is radiated through a protective grill 30 of the casing 12. Unlike with the present invention, in the case of unvented heaters all the combustion gases pass through the grill and into the living space. With vented catalytic heaters of prior designs, such as the design shown in U.S. Pat. No. 4,513,644 while gas sequestering devices were utilized, they did not collect all of the combustion gases and could not comply with rigid certification test requirements which allow no combustion gases to escape to the living space.

The catalytic bed 14 shown in the drawings is of a conventional design, with the present invention residing in the chamber 16, its positioning relative to the catalytic bed 14 and related features as will be described. The present invention further includes a power exhaust blower 32 connected to the chamber 16 by a duct 34. The blower 32 operates in conjunction with the chamber 16 and the catalytic bed 14 to provide the improved catalytic space heater of the present invention, as will be described in more detail below.

To understand the operation of catalytic space heaters, a typical starting sequence for the catalytic heater 10 will now be described. Safety controls including timers (not shown) contained in a compartment 35 are energized as are the ignition wires 18, the power exhaust blower 32 and a gas valve circuit. The circuit includes a differential pressure switch 36 which serves as a proof of venting device and which is connected in series with the gas supply valve 28 by the wires 38. The differential pressure switch 36 is connected to high pressure and low pressure pitot tube pressure taps 42 in an exhaust duct 44 to sense impact pressure and static pressure, respectively, in the exhaust duct 44. The exhaust duct 44 is connected to the exhaust blower 32 to transport exhaust gases to the atmosphere exterior of the living space. When the pressure taps 42 detect sufficient air movement in the duct 44 to prove complete venting of the combustion products will occur, the differential pressure switch 36 completes the circuit which includes the gas supply valve 28 to open the valve and allow gas fuel to flow to the catalytic bed 14 for starting of combustion.

Once combustion has commenced, the catalytic bed 14 produces combustion gases as the by-product of the fuel combustion. With the catalytic space heater 10 of the present invention, all of the combustion gases are collected and conducted outside of the living space in conformance with the most rigid building, installation and use codes and design certification requirements now in existence. The burning of the gas fuel at the forward surface 24 of the catalytic bed 14 through the combustion process produces an upward flow of combustion gases along the bed forward surface that rise due to their own buoyancy. The gases include a portion which is in laminar flow 46 and positioned immediately adjacent to the bed surface, and a portion which is in turbulent flow 48 and positioned away from the bed surface forward of the laminar flow (outward of the laminar flow in the direction toward the protective grill 30 and the living space). The combustion gases mix with the room air to a certain extent.

In the presently preferred embodiment of the catalytic space heater 10, the upright forward surface 24 of the catalytic bed 14 is defined by upper and lower borders 24*a* and 24*b*, respectively, and left and right side borders (right side border 24*c* is shown in FIG. 4). As previously noted, the exposed bed surface 24 generates during operation of the heater 10 under a flow of gas fuel, a flow of combustion gases that partially consists of the laminar flow 46 and partially consists of the turbulent flow 48 forwardly thereof, both of which being substantially smokeless gaseous combustion products which flow upward along the bed surface. Each of these flows extends laterally between the left and right bed side borders.

In accordance with the present invention, the collection chamber 16 is positioned above the bed 14, and has a lower wall 50 and an upper wall 52. Each of the collection chamber walls 50 and 52 extend laterally substantially between the left and right bed side borders. The lower wall 50 has a rearward wall portion 54 extending from a position rearward of the bed surface and terminating at a forward edge portion 56 located above the bed surface 24. The upper wall 52 also has a rearward wall portion 58 extending forward from a position rearward of the bed surface 24 to a position rearward of the bed surface. The upper and lower rearward wall portions 58 and 54 are spaced apart to define an interior collection space 60 therebetween. The lower rearward wall portion 54 has formed therein a circular flange 62 defining an exhaust opening 64 in the lower wall 50. The exhaust duct 34 is connected to the flange 62 to define an exhaust flow from the collection space 60. As previously noted, the power exhaust blower 32 is connected to the exhaust duct 34 and promotes a flow therethrough and through the exhaust duct 44 in the direction of the arrow indicated by reference numeral 66.

The lower wall 50 further has a baffle wall portion 68 extending laterally between the left and right bed side borders and projecting upwardly from the lower forward edge portion 56. The baffle wall portion 68 terminates at a baffle wall upper edge portion 70 spaced below the upper rearward wall portion 58 by a distance sufficient to create a pressure drop in an area 72 within the chamber 14 between the collection space 60 and an inlet space 74 forward of the baffle wall portion. The pressure drop created in the area 72 provides a substantially uniform intake draw along the length of the baffle wall portion 68. By creating the pressure drop evenly along the length of the baffle wall, the exhaust duct 64 is prevented from drawing only from the center portion of the inlet opening as it would otherwise tend to do since it is centrally located between the left and right ends of the collection chamber.

In a preferred embodiment of the invention, the baffle wall portion 68 projects rearwardly from the lower forward wall portion 56 at a rearwardly slanted angle between 30 to 60 degrees relative to the bed forward surface 24, with a preferred angle for the baffle wall portion being 45 degrees in the embodiment shown in the drawings. The baffle wall portion 68 has uniform angle and height along its length such that the baffle wall upper edge portion 70 is substantially equidistant from the upper rearward wall portion 58 along the full length of the baffle wall portion to provide the low pressure area 72 with a uniform height. Moreover, the baffle wall portion has a slanted angle and a height which preferably positions the baffle wall upper edge portion 70 rearward of the bed surface 24 and forward of the exhaust outlet 64.

The slanted baffle wall portion 68 provides the inlet space 74 with an upwardly expanding interior space in which the laminar flow 46 and the turbulent flow 48 can expand immediately and progressively upon entering the inlet space. Allowing such rapid expansion avoids the flows 46 and 48 upon entering the inlet space 74 and encountering the inherent flow resistance therein, from displacing a curtain flow of air 76 which, as will be described below, is drawn into the inlet space to prevent escape of the turbulent flow 48.

The upper wall 52 has a forward wall portion 78 projecting from the upper rearward wall portion 58 in the forward direction beyond the bed surface 24 and, as viewed from the side in FIG. 2, curving downward and terminating at an upper wall forward edge portion 80 positioned generally above the bed surface 24 and spaced forwardly thereof. The upper forward wall portion 78 and the baffle wall portion 68 define therebetween the previously discussed inlet space 74, and a downwardly facing inlet space opening 82 leading to the inlet space and communicating with the air supply in the living space. The opening 82 extends laterally between the left and right bed side borders of the bed surface 24.

The upper forward wall portion 78 is designed to project sufficiently forward of the bed surface 24 to extend forward beyond the turbulent flow 48 and provide the inlet opening 82 with a sufficiently large size in the forward direction to capture therein both the laminar flow 46 and the turbulent flow 48 when rising under their natural buoyancy, and also to draw into the inlet space 74 under the influence of the exhaust flow created by the exhaust blower 32 the previously discussed curtain flow of air 76 from the living space. The curtain flow of air 76 provides a barrier to block escape or spillage of the turbulent flow 48 from entry into the chamber 16 which could otherwise occur by the turbulent flow 48 passing forward of the upper wall forward edge portion 80 as it flows upward.

With the chamber 16 of the present invention, it has been found that the exhaust blower 32 can be run at a reasonably low speed to minimize noise and avoid usage of such an exhaust flow so large that combustion efficiency of the catalytic space heater 10 is reduced by withdrawing more than minimal amounts of the combustion gases before they have fully completed the combustion process. Of course, if combustion gases are withdrawn prior to completion of the combustion process, the fuel is not fully converted to heat and is partially wasted, thus resulting in lower fuel efficiency for the heater.

It has also been found that with the present invention a much lower exhaust duct differential pressure for the exhaust flow can be achieved before a spillover condition exists. In other words, a relatively high adverse wind condition at the exterior exhaust outlet for the heater 10 or a more severely blocked flue used with the heater (which results in lower differential pressure in the exhaust ducts 34 and 44) can be tolerated before the laminar flow 46 or the turbulent flow 48 spills over forward of the upper wall forward edge portion 80 into the living space.

In addition, this has the benefit that the exhaust blower 32 need not be run at very high speeds to create sufficient pressure in the exhaust duct 44 to exceed the pressure needed to prevent spillage and keep the heater 10 operating. As noted above, if the pressure taps 42 sense insufficient differential pressure the gas valve 28 will be turned off to terminate the flow of fuel to the catalytic bed 14, thus causing a nuisance fuel lockout condition. With the present invention, the exhaust pressure at which spillover occurs is sufficiently low that nuisance fuel lockouts occur only in extremely unusual conditions, unlike prior art catalytic heaters which have high pressure spillover points, thus require high exhaust pressures be maintained. As a result, prior art heaters experience nuisance fuel lockouts more frequently than desirable due to only slightly adverse wind conditions or partially blocked flue conditions that reduce pressures enough for the safety mechanisms to terminate the flow of fuel in order to prevent spillover, whereas the same conditions in the present invention would not. It should be noted that the causes of spillage are not limited to adverse wind conditions and partially blocked flues, and these are just two very typical problem situations.

Since a high speed, high pressure exhaust blower is not required, the exhaust blower 32 of the present invention is sized to create a sufficient exhaust flow to produce the curtain flow of air 76 that blocks the escape of the turbulent flow 48 and also to produce an exhaust flow of a predetermined low level selected to be greater than the exhaust flow below which spillage would occur (i.e., below which the pressure taps 42 cause termination of the flow of fuel). The exhaust blower 32 need not, however, create so great an exhaust flow that a significant reduction in the fuel efficiency of the heater 10 occurs as a result of withdrawing the gaseous combustion products prior to there being substantially fully combusted. Nor is excess heated room air withdrawn from the living space beyond that necessary to form the curtain flow of air 76.

Figure 1:
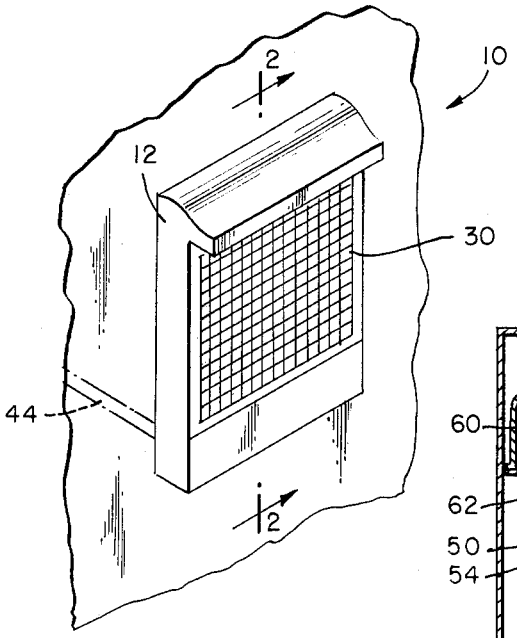
FIG. 1 is a perspective view of a catalytic space heater embodying the present invention.

In accordance with another aspect of the present invention shown in FIG. 4, a spacer bar 84 is positioned between the lower wall 50 and the catalytic bed 14 to position the upper border **24*a* of the forward bed surface 24 at an increase distance below the inlet opening 82 than exits in the embodiment of FIG. 1. With this arrangement, the catalytic bed 14 is positioned sufficiently far away from the inlet opening 82 to further ensure that complete combustion of the laminar flow and the turbulent flow gaseous combustion products has occurred before the flows enter into the inlet space 74. This further ensures that more efficient combustion will occur, thus creating heat rather than being drawn into the inlet space 74 and exhausted away particularly for the gaseous combustion products which are produced at the upper regions of the catalytic bed 14**. This has been a particular problem in prior art catalytic heaters, such as the one shown in U.S. Pat. No. 4,513,644 where the chamber is positioned immediately above the upper border of the catalytic bed forward surface. With the chamber located so close to the bed surface gas fuel is drawn into the chamber from the upper regions of the forward bed surface before the combustion process has a chance to be fully completed.

Figure 6:
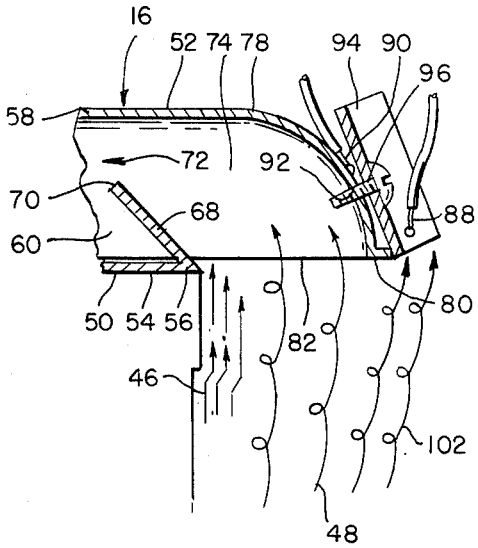
FIG. 6 is an enlarged fragmentary, sectional side elevational view of the chamber and catalytic bed shown in FIG. 5 with thermocouples mounted thereto as shown in FIG. 3 for test purposes, and schematically showing the spillage of turbulent flow into the living space.

The means used to show complete collection of the combustion gases by the catalytic space heater 10 of the present invention to satisfy design certification agencies is illustrated in the drawings and will be described below. In particular, as shown in FIGS. 3 and 6, an air temperature sensing thermocouple 88 and a metal temperature sensing thermocouple 90 are positioned on the exterior of the upper forward wall portion 78 of the chamber 14. Similar pairs of thermocouples (not shown) are positioned spaced apart along the length of the upper forward wall portion 78 at the locations indicated by the attachment holes 92, shown in FIG. 3. The air sensing thermocouple 88 is positioned within a draft shield 94 to minimize erratic temperature readings as a result of lateral air currents. As best shown in FIG. 6, the draft shield 94 is attached to the upper forward wall portion 78 by an attachment screw 96 threaded into one of the attachment holes 92. The plurality of thermocouple pairs 88 and 90 are positioned at appropriate intervals along the portion of the chamber 16 whereat the hot gaseous combustion products are likely to spill into the living space. The thermocouple 90 is positioned in contact with the upper forward wall portion 78 to measure the temperature of the metal from which the wall is manufactured, and the air sensing thermocouple 88 is positioned to measure the air temperature of the air just outside and above the upper wall forward edge portion 80.

To conduct the test, the spillage safety controls (i.e., the differential pressure switch 36) is disabled so that the catalytic space heater 10 will continue to operate even at very low exhaust duct pressures. The heater 10 is then operated for a sufficient period of time at the highest designed gas fuel rate until the heater temperature stabilizes. For the purpose of the test, the exhaust duct 44 is connected to a valve 98 (shown in FIG. 2 in the broken line box showing the test apparatus) which is used to selectively and progressively block the exhaust duct and simulate a blocked flue situation.

In addition, a differential pressure gauge 100 which also comprises part of the test apparatus in FIG. 2 is attached to the pressure taps 42 to measure the differential pressure being sensed within the exhaust duct 44. Once the heater 10 has reached a stabilized temperature, the test procedure then requires the test valve 98 be progressively closed to simulate a progressively blocked flue situation, and the temperature readings of each of the thermocouple pairs of 88 and 90 be recorded simultaneously. These readings are plotted on the graph of FIG. 7 as a function of the differential pressure in the exhaust duct 44 (measured in the height of a water column) sensed by the differential pressure gauge 100. The differential pressure is indicative of exhaust flow. The exhaust duct pressure at which the "metal" temperature curve shows a sudden rate of rise indicates a pre-spillage point in that the upper forward wall portion 78 is rapidly heating up as a result of a slow flow rate of gases in the inlet space 74 adjacent the upper forward wall portion. At this point in time, the "air" temperature curve, while increasing as the exhaust duct pressure decreases, shows no sudden change in temperature because the gas flow is still being maintained fully within the inlet space 74. Upon closing the test valve 98 still more to further reduce the exhaust duct flow in the exhaust duct 44, the air temperature curve will eventually show a sudden rate of rise either at or immediately after pressure at which the pre-spillage point is indicated on the metal temperature curve. This point on the air temperature curve constitutes the spillage point, as indicated on FIG. 7, at which the hot gases spilled around the chamber 14 forward of the upper forward wall portion 78 and encountered the air sensing thermocouple 88, as shown schematically in FIG. 6 by the spillage flow 102.

In such manner, the spillage point is confidently determined. While the test to this point has determined the exhaust duct differential pressure at which spillage will occur, it is still necessary to repeat the test with the vent safety controls (i.e., the differential pressure switch 36) enabled to prove that the gas valve 28 will function to lock out the supply of fuel through the gas supply tube 26 before the spillage point is reached in case the exhaust duct pressure should decrease. This test was run successfully with the catalytic space heater 10 of the present invention which proved to have an extremely low spillage point in terms of the spillage not occurring until a very low exhaust duct pressure was reached. As noted above, this allows the use of a low speed, low pressure exhaust blower 32 and allows the heater 10 to maximize combustion efficiency by minimal withdrawal of gases that have not completed their combustion process.

The spacer 84 has a forward facing separating surface 85 that is in the same plane as the forward surface 24 of the catalytic bed 14, and the surface can have a height to separate the inlet opening 82 from the upper border 24*a* of the forward bed surface 24 by a distance of 6 inches. The spacer 84 also provides a potentially useful surface to which temperature sensing switches can be positioned for use as proof of ignition sensors.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A catalytic space heater for heating an enclosed living space, comprising:

a catalytic bed having an upwardly extending forward surface positionable to be openly exposed to the living space and defined by upper and lower borders and left and right side borders, said exposed bed surface generating during operation of the heater under a flow of fuel a partially laminar flow and a partially turbulent flow of substantially smokeless gaseous combustion products upward along said bed surface, each flow extending between said left and right bed side borders, said laminar flow being adjacent said bed surface and said turbulent flow being positioned forward of said laminar flow;

a control sensing flow in an exhaust duct, and terminating said fuel flow to said catalytic bed if the sensed flow is below a predetermined level indicative of insufficient flow for safe operation;

a pressure source sufficient to create a negative pressure exhaust flow in said exhaust duct; and a collection chamber positioned above said bed and having a lower wall and an upper wall, each wall extending laterally substantially between said left and right bed side borders, said lower wall having a rearward wall portion generally rearward of said bed surface and terminating at a forward edge portion, said upper wall having a rearward wall portion generally rearward of said bed surface and spaced above said lower rearward wall portion to define an interior collection space therebetween, said pressure source being connected to said interior collection space to create said exhaust flow from said collection space, said lower wall further having a baffle wall portion extending laterally substantially between said left and right bed side borders and projecting upwardly from said forward edge portion and terminating at a baffle wall upper edge portion spaced below said upper rearward wall portion to create a pressure drop between said collection space and an inlet space forward of said baffle wall portion and to provide a substantially uniform draw along the length of said baffle wall portion, said upper wall further having a forward wall portion projecting forward beyond said bed surface and downward and terminating at an upper wall forward edge portion, said upper forward wall portion and said baffle wall portion defining said inlet space therebetween, said upper wall forward edge portion being positioned generally above said bed surface and spaced forwardly thereof sufficient to extend forward beyond said turbulent flow and define an opening to said inlet space communicating with the living space and extending laterally substantially between said left and right bed side borders, with said opening being sufficiently large in the forward direction to capture therein both said laminar flow and said turbulent flow when rising under their natural buoyancy and to draw in under the influence of said pressure source a curtain flow of air from the living space positioned forward of said turbulent flow and extending laterally substantially between said left and right bed side borders to block escape of the upward flow of said turbulent flow forward of said upper wall forward edge portion, said pressure source creating a sufficient exhaust flow to produce said curtain flow of air to block escape of said turbulent flow, and also to cause the exhaust flow to be above said predetermined level under normal operation to prevent said sensor control from terminating said flow of fuel, but not to be so great as to reduce the fuel efficiency of the heater by withdrawing said gaseous combustion products prior to being substantially fully combusted to reduce the heating efficiency below by withdrawing air from the living space beyond that necessary to create the curtain flow of air.

2. The catalytic space heater of claim 1 wherein said baffle wall portion projects rearwardly from said lower forward edge portion at a rearwardly slanted angle to form said inlet space as an upwardly expanding interior space in which said laminar flow and said turbulent flow can expand immediately and progressively upon entering said inlet space to avoid said flows encountering flow resistance upon entering said inlet space and thereby displacing said curtain flow of air from said inlet space.

3. The catalytic space heater of claim 1 wherein said baffle wall slanted angle is between 30 to 60 degrees relative to said bed forward surface.

4. The catalytic space heater of claim 1 wherein said baffle wall upper edge portion is substantially equidistant from said upper rearward wall portion along substantially the full length of said baffle wall portion.

5. The catalytic space heater of claim 1 further including an outlet in said lower rearward wall portion to which said pressure source is connected, and wherein said baffle wall upper edge portion terminates at a position rearward of said bed surface and forward of said outlet.

6. The catalytic space heater of claim 1 wherein said bed is positioned with said upper border of said bed surface below said collection chamber lower wall by a sufficient distance to insure substantially complete combustion of said laminar flow and said turbulent flow before entering into said inlet space opening.

7. The catalytic space heater of claim 6 further including a spacer positioned between said bed and said collection chamber lower wall, said spacer having a generally upright forward solid surface generally coplanar with said bed surface.

8. The catalytic space heater of claim 7 wherein a forwardmost portion of said baffle wall portion defines the rearward extent of said inlet opening and is positioned substantially directly above said spacer forward surface.

9. The catalytic space heater of claim 1 further including an outlet for said collection chamber, said outlet being centrally located between left and right lateral sidewalls of said chamber to provide generally symmetrical left and right collection chamber portions with respect to said outlet, said left and right collection chamber portions having a substantially uniform height.

10. The catalytic space heater of claim 1 wherein said collection space has sufficient volume along the length of said baffle wall portion to collect said gases evenly along said baffle wall portion at the lowest operational draw for the heater.

* * * * *